United States Patent [19]

Thomas et al.

[11] 4,042,381

[45] Aug. 16, 1977

[54] CONTROL OF INCLUSION MORPHOLOGY IN STEEL

[75] Inventors: Jerry D. Thomas, North Royalton, Ohio; William F. Hladio, Homewood, Ill.; Leo V. Scott, Warren, Ohio

[73] Assignee: Republic Steel Corporation, Cleveland, Ohio

[21] Appl. No.: 702,427

[22] Filed: July 6, 1976

[51] Int. Cl.[2] ..... C21C 7/00; C22C 33/00

[52] U.S. Cl. ..... 75/129; 75/58; 75/123 E; 75/123 M

[58] Field of Search ..... 75/58, 129, 123

[56] References Cited

U.S. PATENT DOCUMENTS

| | | | |
|---|---|---|---|
| 3,218,156 | 11/1965 | Sluis | 75/58 |
| 3,769,004 | 10/1973 | Barnhardt | 75/58 |
| 3,816,103 | 6/1974 | Link | 75/58 |

*Primary Examiner*—Peter D. Rosenberg

*Attorney, Agent, or Firm*—Watts, Hoffmann, Fisher & Heinke

[57] ABSTRACT

Effective, low cost sulfide shape control is obtained using in combination titanium and a rare earth metal, e.g., mischmetal, in steels meeting the following specifications: at least 0.020% aluminum, no more than 0.010% nitrogen, no more than 0.025% sulfur, no more than 0.70% manganese, at least 0.020% titanium, and at least 0.020% of at least one rare earth metal. The steels are characterized by sulfide inclusions having a globular and/or fine, short blocky shape.

9 Claims, No Drawings

CONTROL OF INCLUSION MORPHOLOGY IN STEEL

BACKGROUND OF THE INVENTION

The present invention relates generally to improvements in controlling the inclusion morphology in steel, and more specifically to practices and compositions which make it possible to achieve shape control of nonmetallic inclusions, particularly sulfides, in an improved manner.

It is recognized that the shape of sulfide inclusions affects the physical properties of steel. Elongated, stringy sulfides adversely affect transverse mechanical properties such as ductility, formability, toughness, etc., whereas these properties are improved by a morphology characterized by the presence of globular or blocky sulfides. A conventional method of obtaining the desired morphology in aluminum killed steels has been to add a rare earth metal or a mixture of rare earth metals, e.g., mischmetal, to the ingot molds during teeming. In one typical practice, a mischmetal addition is made to the molds in an amount of one pound per ton of steel. The sulfide shape achieved by mischmetal treatment is predominently globular or spherical.

It has also been proposed to use either zirconium or titanium instead of mischmetal as the sulfide shape control agent. Another proposal in the literature has been to employ mischmetal and calcium in combination as a mold addition.

SUMMARY OF THE INVENTION

The invention provides improved inclusion shape control practices which make it possible to form shaped sulfides at a lower cost and with equal or greater effectiveness than when using mischmetal of other shape control agents on an individual basis as has been conventional.

It has been found that it is possible to achieve good sulfide shape control results using mischmetal or other rare earth metal and titanium in combination if the chemistry of the steel is controlled within certain limits and the rare earth metal and titanium are added to the steel in a specially prescribed manner. The use of titanium in combination with a rare earth metal is advantageous because it materially reduces the amount of the rare earth metal that is necessary and thereby reduces the cost of obtaining the shaped morphology required for good ductility, toughness and formability. In order to achieve significant sulfide shape control in steel, it was generally considered necessary prior to the present invention to have a total rare earth metal (REM) to sulfur ratio (REM/S) of at least 3 or a cerium to sulfur ratio of at least 1.5 where mischmetal was used as the source of the rare earth metal. It is now possible by the practice of the invention to achieve effective sulfide shape control with a REM/sulfur ratio as low as one and a cerium to sulfur ratio as low as 0.5 when using mischmetal in combination with titanium.

The effective use of titanium and rare earth metal in accordance with the inclusion shape control practice of the invention is made possible by controlling the steel chemistry to the following specifications: aluminum 0.020% minimum; nitrogen 0.010% maximum, sulfur 0.025% and more preferably 0.015% maximum; manganese 0.70% maximum; 0.020–0.080% titanium; and 0.020–0.060% rare earth metal content. The term "rare earth metal" is used to mean cerium, lanthanum, praseodymium, neodymium, yttrium, scandium, and mixtures thereof such as mischmetal. Amounts of titanium and rare earth metal in excess of the indicated maximum contents do not significantly contribute to sulfide shape control and are therefore considered uneconomic. In order to avoid cleanliness problems and to realize the low cost advantages of the invention, it is preferred that the titanium content be in the range of from 0.020–0.030% and that it does not exceed 0.060%, and that the rare earth metal content be about 0.020% and that it does not exceed 0.040%.

Recent research indicates that 0.020–0.060% titanium significantly affects the solidification structure (columnar growth) of low carbon aluminum killed steels. The residual titanium contents restrict columnar growth which in turn restricts the nucleation and growth of sulfide inclusions. Very fine sulfide inclusions are formed which during rolling do not elongate to any significant length. Thus, the sulfide shape control according to the invention is derived from two sources which are: (1) the minimized rare earth content of 0.02 to 0.04% and (2) the changed solidification structure as a result of the 0.02 to 0.06% Ti. Although the rare earth content may slightly affect the solidification structure of the ingot, it mainly provides sulfide shape control by the formation of rare earth sulfides, rare earth oxysulfides, and rare earth modified manganese sulfides. Although the titanium content may possibly react with the sulfur in the molten steel to form titanium sulfides, its main contribution is its effect on the solidification structure.

The method of sulfide shaped control provided by this invention is applicable to aluminum killed steels, high strength low alloy steels, plain carbon steels, and other steel grades which meet the foregoing specifications. In carrying out the preferred method, the titanium should be added with or after the aluminum addition to the heat, and the rare earth metal should be added with or after the titanium.

Steels produced in accordance with the invention are characterized by sulfide inclusions having a globular and/or fine, short blocky, e.g., elliptical, shape. The shape of sulfide inclusions in rolled steel products are predominantly of the latter type rather than globular. In such instances, the fine size of the short blocky inclusions is typically on the order of 25 microns or less.

Further advantages and a fuller understanding of the invention will be apparent from the following detailed description of preferred embodiments.

DESCRIPTION OF THE PREFERRED EMBODIMENTS

Several heats of steel were made using titanium and rare earth metal as the sulfide shape control agent pursuant to the invention. The results of the new practice were compared to steel heats treated in a conventional manner by the addition of one pound of mischmetal per ton of steel to the ingot molds and to steel heats which were untreated. As hereinafter described. various analyses of the heats were made to evaluate the effectiveness of the titanium-rare earth metal treatment in attaining sulfide shape control.

The steel making practices used to make the heats are described in Table I. The cleanliness of the steels was frequently evaluated and these results are also listed in Table I. The steel compositions of the various heats are given in Tables II-A and II-B together with the approximate total rare earth metal (REM) content and the ratio of cerium to sulfur. Metallographic and microprobe evaluations of the nonmetallic inclusions in the slab and hot band samples are described in Table III.

The formability of steels of the grades described is often most critical in the transverse direction of the hot band or skelp. Accordingly, the bendability or formability of cold sheared transverse samples in a press-brake were determined, as indicated in Table IV. The bendability is a function of the extent of edge cracking at the bend of the samples, and the results of evaluating edge cracking are listed in Table IV.

TABLE I.

| Heat No. | Grade | Special Ladle Additions | Special Mold Additions | Ingot No. | Hot Band No. | Macroetches |
|---|---|---|---|---|---|---|
| 2425656 | 1020 A.K. + Si, Ti, REM | 3.6 lbs/t mischmetal | None (BOF heat blocked with 15% FeSi containing approx. 3% Ti.) | 3<br>7 | 5B, 5F<br>7B, 7F | Not recorded |
| 2416723 | 1010 A.K. + Ti, REM | none | 1 lb./t mischmetal | 10T<br>10B | 6B<br>6F | Not recorded |
| | | | ½lb./t mischmetal + ½lb./t Ti as 70% FeTi | 8T<br>8B | 4B<br>4F | Not recorded |
| | | | ½lb./t mischmetal + ½lb./t Ti as 70% FeTi | 9T<br>9B | 5B<br>5F | Not recorded |
| 2440338 | 1010 A.K. | none | none | — | 1,2 | |
| 2440745 | 1010 A.K. | 1 lb./t 70% FeTi | 0.6 lb./t mischmetal | 5T<br>5B | 1B<br>1F | 5T-clean, 1 cluster indication; 5B-clean, small indication |
| | | | 0.6 lb./t mischmetal | 6T<br>6B | 2B<br>2F | 6T clean, 6B minor clean indications |
| | | | 0.6 lb./t mischmetal | 7T<br>7B | 3B<br>3F | 7T-small; clean indications |
| | | | none | 8T<br>8B | 4B<br>4F | 8T- 1 small, clean indication<br>8B- several small clean indications |
| 2440535 | 1010 A.K. | none | none | 1T<br>1B | 1B<br>1F | 1T - dirty at mill edge and some subsurface clusters |
| | | | 1 lb./t mischmetal | 2T<br>2B | 2B<br>2F | 2T - very dirty along mill edge width and some subsurface clusters |
| | | | ½lb./t mischmetal + ½lb./t Ti as 70% FeTi. | 3T<br>3B | 3B<br>3F | 3T clean, no cluster |
| | | | 1 lb./t mischmetal + ½lb./t Ti as 70% FeTi. | 4T<br>4B | 4B<br>4F | 4T clean, small subsurface clusters |
| 2442414 | Approx. 1015 A.K. | none | none | 8 | 4B<br>4F | |
| | | | 1 lb./t mischmetal | 9 | 3B<br>3F | |
| | | | none | 10 & 11 | — | |
| | | | 1 lb./t mischmetal + ½lb./t Ti as 70% FeTi | 12 | 1B<br>1F | |
| | | | ½lb./t mischmetal + ½lb./t Ti as 70% FeTi | 13 | 2B | |
| 2443225 | X-52 Cb & Al killed + Ti & mischmetal | 1 lb./t 70% FeTi | ½lb./t mischmetal to each ingot | 2T, 2B<br>9T, 9B<br>17T, 17B | RSS3225<br>XSS3225 | 2T - clean; some indications; 2B - clean; 9T - clean, at subsurface, dity at M. E; 9B- clean; 17T - dirty; 17B - clean |
| 2443322 | 1026 A.K.+ Ti & mischmetal | 1 lb./t -70% FeTi | ½lb./t mischmetal to each ingot | 1T, 1B<br>10T, 10B<br>19T, 19B | 12F, 12B<br>17F, 17B<br>18F, 18B | 1T- clean; 1B- clean; 10T- clean; 10B-clean; 19T- dirty; 19B- clean |
| 2443185 | X-52 Cb & Al killed + mischmetal | none | 1 lb./t mischmetal to each ingot | none | RSS3185<br>XSS3185 | none |

TABLE II - A

Average Chemical Analyses of slabs and hot band samples

| Heat No. | Ingot No. | Hot Band No. | C | Mn | S | Al | Si | N | O | Ce | La | Ti | Approx. Total REM | Ce/S |
|---|---|---|---|---|---|---|---|---|---|---|---|---|---|---|
| 2425656 | 3<br>7 | 5B,5F<br>7B,7F | .26 | .48 | .009 | .075 | .20 | .007 | .003/<br>.008 | .01 | .004 | .02 | .02 | 1.1 |
| 2416723 | 10T<br>10B | 6B<br>6F | .11<br>.10 | .36<br>.33 | .012<br>.011 | .056<br>.057 | .01<br>" | .005<br>.004 | .004<br>.005 | .016<br>.017 | .006<br>.009 | <.01<br><.01 | .032<br>.034 | 1.45 |
| | 8T<br>8B | 4B<br>4F | .11<br>.11 | .35<br>.36 | .012<br>.011 | .056<br>.057 | "<br>" | .004<br>.004 | .004<br>.004 | .007<br>.006 | .002<br>.002 | .021<br>.020 | .014<br>.012 | 0.5 |
| | 9T<br>9B | 5B<br>5F | .11<br>.10 | .37<br>.37 | .011<br>.012 | .058<br>.058 | "<br>" | .004<br>.004 | .005<br>.005 | .008<br>.008 | .003<br>.003 | .030<br>.028 | .016<br>.016 | 0.7 |
| 2440338 | — | 1,2 | .12 | .44 | .013 | .047 | .01 | .005 | .002/<br>.003 | <.005 | <.0005 | <.01 | 0 | 0 |
| 2440745 | 5T<br>5B | 1B<br>1F | .095<br>.09 | .36<br>.36 | .013<br>.013 | .044<br>" | .02<br>.02 | .007<br>" | .004<br>.003 | .01<br>.01 | .006<br>.006 | .03<br>.03 | .02<br>.02 | .8 |

-continued

| | | | | | | | | | | | | | | |
|---|---|---|---|---|---|---|---|---|---|---|---|---|---|---|
| | 6T | 2B | .095 | .36 | .013 | " | .02 | " | .003 | .01 | .005 | .028 | .02 | .8 |
| | 6B | 2F | .09 | .36 | .013 | " | .02 | " | .004 | .01 | .005 | .028 | .02 | |
| | 7T | 3B | .095 | .37 | .013 | " | .01 | " | .004 | .01 | .005 | .03 | .02 | .8 |
| | 7B | 3F | .09 | .36 | .013 | " | .01 | " | .004 | .01 | .007 | .03 | .02 | |
| | 8T | 4B | .10 | .37 | .013 | " | .01 | " | .002 | <.005 | <.0005 | .028 | 0 | 0 |
| | 8B | 4F | .09 | .36 | .013 | " | .01 | " | .005 | <.005 | <.0005 | .03 | 0 | 0 |
| 2440535 | 1T | 1B | .07 | .32 | .019 | .033 | <.02 | .004 | .004/ | <.005 | <.0005 | <.01 | 0 | 0 |
| | — | 1F | | | | | | | .005 | | | | | |
| | 2T | 2B | .07 | .35 | .019 | .039 | <.02 | .005 | .006 | .025 | .02 | <.01 | .05 | 1.3 |
| | | 2F | | | | | | | | | | | | |
| | 3T | 3B | .07 | .34 | .020 | .037 | <.02 | .005 | .005 | .01 | .004 | .02 | .02 | 0.5 |
| | | 3F | | | | | | | | | | | | |
| | 4T | 4B | .07 | .35 | .020 | .041 | <.02 | .005 | .004 | .025 | .02 | .02 | .05 | 1.3 |
| | | 4F | | | | | | | | | | | | |
| 2442414 | 8 | 4B | N.A. | N.A. | N.A. | N.A. | N.A. | N.A. | N.A. | <.005 | <.0005 | <.01 | 0 | 0 |
| | | 4F | | | | | | | | <.005 | <.0005 | <.01 | 0 | |
| | 9 | 3B | N.A. | N.A. | N.A. | N.A. | N.A. | N.A. | N.A. | .02 | .007 | <.01 | .04 | 1.7 |
| | | 3F | | | | | | | | .02 | .008 | <.01 | .04 | |
| | 10 & 11 | — | .14 | .45 | .013 | .052 | <.01 | .004 | .003 | <.005 | <.0005 | <.01 | 0 | 0 |
| | 12 | 1B | .14 | .45 | .012 | .052 | <.01 | .005 | .004 | N.A. | N.A. | N.A. | | 1.7 |
| | | 1F | | | | | | | | .02 | .007 | .028 | .04 | |
| | 13 | 2B | .14 | .46 | .012 | .06 | <.01 | .004 | .003 | .01 | .004 | .024 | .02 | 0.8 |
| | | 2F | | | | | | | .004 | .01 | .004 | .022 | .02 | |

TABLE II-B

| Heat No. | Ingot No. | Hot Band No. | C | Mn | S | Al | Si | N | O | Ce | La | Ti |
|---|---|---|---|---|---|---|---|---|---|---|---|---|
| 2443225 | 2T, 2B<br>9T, 9B<br>17T, 17B | RSS3225<br>XSS3225 | .11 | 1.0 | .015 | .020 | .025 | .006/<br>.007 | .006 | .01 | .005/<br>.006 | .03 |
| 2443322 | 1T, 1B<br>10T, 10B<br>19T, 19B | 12F, 12B<br>17F, 17B<br>18F, 18B | .25 | .76 | .015 | .047 | .02 | .007 | .007 | .009 | .005 | .04 |
| 2443185 | none | RSS3185<br>XSS3185 | .11 | .96 | .012 | .055 | .02 | .006 | .006 | .02 | .009 | <.01 |

| Heat No. | Ingot No. | Hot Band No. | P | Cb | Cu | Ni | Cr | Mo | Approx. Total REM | Ce/S |
|---|---|---|---|---|---|---|---|---|---|---|
| 2443225 | 2T, 2B<br>9T, 9B<br>17T, 17B | RSS3225<br>XSS3225 | <.008 | .029 | .04 | .01 | .02 | <.01 | .02 | |
| 2443322 | 1T, 1B<br>10T, 10B<br>19T, 19B | 12F, 12B<br>17F, 17B<br>18F, 18B | <.008 | <.01 | .04 | .01 | .01 | <.01 | .018 | .6 |
| 2443185 | none | RSS3185<br>XSS3185 | .009 | .031 | .02 | .02 | .02 | <.01 | .04 | 1.7 |

TABLE III

THE NONMETALLIC INCLUSIONS IN NON-TREATED, REGULAR PRACTICE, AND Ti-RE TREATED INGOTS

| | Heat No. | Ingot No. | Nonmetallic inclusions |
|---|---|---|---|
| I. | Non-Treated Ingots | | |
| | 2440338 | — | MnS |
| | 2440535 | 1 T & B | $Al_2O_3$ |
| | 2442414 | 8 T & B | |
| II. | Regular Practice Ingots - 1 lb/t Mischmetal to Molds | | |
| | 2416723 | 10 T & B | Rare earth sulfide; |
| | 2440535 | 2 T & B | rare earth oxysulfide; |
| | 2442414 | 9 T & B | rare earth modified MnS; |
| | 2443185 | | rare earth modified $Al_2O_3$; MnS |
| III. | Titanium + REM treated ingots | | |
| | 2425656 | 3 & 7 | Rare earth sulfide; |
| | 2416723 | 8T & B | rare earth oxysulfide; |
| | 2416723 | 9 T & B | rare earth modified MnS; |

TABLE III-continued

THE NONMETALLIC INCLUSIONS IN NON-TREATED, REGULAR PRACTICE, AND Ti-RE TREATED INGOTS

| | Heat No. | Ingot No. | Nonmetallic inclusions |
|---|---|---|---|
| | 2440745 | 5 T & B, 6 T & B, 7 T & B | rare earth modified $Al_2O_3$; rare earth |
| | 2440535 | 4 T & B | -Ti modified $Al_2O_3$; |
| | 2440535 | 4 T & B | TiN and/or TiCN; MnS |
| | 2442414 | 12 T & B | |
| | 2442414 | 13 T & B | |
| IV. | 2443225 | 2 T & B<br>19 T & B<br>17 T & B | $Al_2O_3$; rare earth modified $Al_2O_3$; rare earth modified; MnS; MnS stringers; TiN and/or TiCN; rare earth sulfide |
| | 2443322 | 1 T & B<br>10 T & B<br>19 T & B | |

TABLE IV

| Hot Band No. | Treatment | Gage, in. | Punch Radius, in. | Die Width, in. | Bend Radius r/t | Edge Crack Length, in. at Smallest r/t | Edge Crack Length, in. at Full Bend |
|---|---|---|---|---|---|---|---|
| I. Heat No. 2416723 | | | | | | | |
| 6 B & F | RE | .131 | .05–.15 | 1.6 | .38–1.16 | None | None |
| 4 B & F | Ti-RE | .132 | .05–.15 | 1.6 | .38–1.16 | None | None |
| 5 B & F | Ti-RE | .132 | .05–.15 | 1.6 | .38–1.16 | None | None |
| II. Heat No. 2440338 | | | | | | | |
| 1 | None | .129 | .075–.15 | 1.6 | .58–1.16 | .13 | General Failure |
| 2 | None | .129 | .075–.15 | 1.6 | .58–1.17 | .08 | General Failure |
| III. Heat No. 2440745 | | | | | | | |
| 4 B & F | Ti Only | .132 | .05–.15 | 1.6 | .38–1.14 | .01–.02 | .02–.03 |
| 3 B & F | Ti-RE | .130 | .05–.15 | 1.6 | .38–1.16 | .01 | .02–.05 |
| 2 B & F | Ti-RE | .130 | .05–.15 | 1.6 | .38–1.16 | .01–.02 | .02–.04 |
| 1 B & F | Ti-RE | .130 | .05–.15 | 1.6 | .38–1.15 | .005–.01 | .02 |
| IV. Heat No. 2440535 | | | | | | | |
| 1 B & F | None | .251 | .075–.20 | 2.0 | .30–.81 | .05–.15 | .09–.11 |
| 2 B & F | RE | .237 | .075–.20 | 2.0 | .32–.85 | .01–.06 | .03–.13 |
| 3 B & F | Ti-RE | .240 | .075–.20 | 2.0 | .32–.84 | .02–.05 | .03–.07 |

TABLE IV-continued

| Hot Band No. | Treatment | Gage, in. | Punch Radius, in. | Die Width, in. | Bend Radius r/t | Edge Crack Length, in. at Smallest r/t | Edge Crack Length, in. at Full Bend |
|---|---|---|---|---|---|---|---|
| 4 B & F | Ti-RE | .246 | .075-.20 | 2.0 | .30-82 | .02-.03 | .02-.04 |
| V. Heat No. 2442414 | | | | | | | |
| 1 F | Ti-RE | .108 | .05-.15 | 1.0 | .46-1.39 | .01 | 0.1 |
| 2 B & F | Ti-RE | .107 | .05-.15 | 1.0 | .46-1.40 | .01 | .02 |
| 3 B & F | RE | .105 | .05≧.15 | 1.0 | .47-1.43 | .01 | .01-.02 |
| 4 B & F | None | .104 | .05-.15 | 1.0 | .47-1.49 | .02-.04 | .15 |
| VI. Heat No. 2443225 | | | | | | | |
| RSS-3225 | Ti-RE | 0.318 | 0.3-0.5 | 3.0 | 0.94-1.57 | 0.70 | N.A. |
| XSS-3225 | Ti-RE | 0.325 | 0.3-0.5 | 3.0 | 0.92-1.54 | 0.87 | N.A. |
| VII. Heat No. 2443185 | | | | | | | |
| RSS-3185 | RE | 0.313 | 0.15-0.5 | 3.0 | 0.48-1.60 | 0.28 | N.A. |
| XSS-3185 | RE | 0.313 | 0.15-0.5 | 3.0 | 0.48-1.60 | 0.13 | N.A. |
| VIII. Heat No. 2443322 | | | | | | | |
| B12 | Ti-RE | 0.215 | 0.1-0.25 | 2.0 | 0.46-1.16 | 0.02-0.05 | N.A. |
| F12 | Ti-RE | 0.217 | 0.1-0.25 | 2.0 | 0.46-1.15 | 0.01-0.02 | N.A. |
| B17 | Ti-RE | 0.211 | 0.1-0.25 | 2.0 | 0.47-1.18 | 0.02 | N.A. |
| B18 | Ti-RE | 0.216 | 0.1-0.25 | 2.00 | 0.46-1.15 | 0.03 | N.A. |
| F18 | Ti-RE | 0.213 | 0.1-0.25 | 2.00 | 0.46-1.17 | 0.04-0.05 | N.A. |

Heats 2425656 (ingots 3, 7), 2416723 (ingots 8, 9), 2440745 (ingots 5, 6, 7), 2440535 (ingots 3, 4) and 2442414 (ingots 12, 13) were made by the titanium and mischmetal addition practice of the invention. Ingot no. 10 of heat 2416723, ingot no. 2 of heat 2440535, ingot no. 9 of heat 2442414, and heat 2443815 were made by the conventional practice of using mischmetal alone as the shape control agent. It will be seen from Table III that the nonmetallic inclusions resulting from both types of treatment were similar. As indicated in Table IV, formability results obtained by the titanium and mischmetal treatment compared favorably to those obtained by the conventional mischmetal treatment. Thus, the invention makes it possible to achieve the benefits of conventional shape control practice while using 50% less mischmetal.

The criticality of the manganese content is demonstrated by heats 2443225 and 2443322. As indicated in Table II-B, the slab and hot band samples from both heats had an average manganese content exceeding 0.70%. Except for the high manganese content, both heats were prepared following the practice of the invention using a titanium and mischmetal addition. The microprobe and metallographic evaluations reported in Table III showed that the nonmetallic inclusions included manganese sulfide stringers and alumina similar to untreated steels. As reported in Table IV, it was also found that the high manganese content adversely affected the average formability results.

Many modifications and variations of the invention will be apparent to those skilled in the art in light of the foregoing description. Therefore, it is to be understood that, within the scope of the appended claims, the invention can be practiced otherwise than as specifically disclosed.

What is claimed is:

1. A method of producing steel characterized by shaped sulfide inclusions comprising the steps of preparing a steel melt containing in amounts by weight:

at least 0.020% aluminum
no more than 0.010% nitrogen
no more than 0.025% sulfur
no more than 0.70% manganese and incorporating in said melt from 0.020–0.080% titanium and from 0.020–0.060% of at least one rare earth metal.

2. The method as claimed in claim 1 wherein the titanium is incorporated in said melt no earlier than the aluminum, and wherein the rare earth metal is incorporated in said melt no earlier than the titanium.

3. The method as claimed in claim 1 wherein the titanium is present in a maximum amount of 0.060%, and wherein the rare earth metal is present in a maximum amount of 0.040%.

4. The method as claimed in claim 1 wherein the rare earth metal is mischmetal.

5. A method of producing steel characterized by shaped sulfides comprising the steps of preparing in a furnace a steel melt containing in amounts by weight:

no more than 0.010% nitrogen
no more than 0.025% sulfur
no more than 0.70% manganese; transferring the melt to a ladle and incorporating in the melt at least 0.020% aluminum and from 0.020–0.060% titanium, the titanium being added to the melt after the aluminum; maintaining the melt with the foregoing composition; pouring the melt into a mold; and incorporating in the melt a mold addition of from 0.020–0.040% mischmetal.

6. A method of producing steel characterized by shaped sulfides comprising the steps of preparing in a furnace a steel melt containing in amounts by weight:

no more than 0.010% nitrogen
no more than 0.025% sulfur
no more than 0.70% manganese;

transferring the melt to a ladle and incorporating in the melt at least 0.020% aluminum and maintaining the melt in the foregoing composition; pouring the melt into a mold; and incorporating in the melt a mold addition of from 0.020–0.060% titanium followed or accompanied by a mold addition of from 0.020–0.040% mischmetal.

7. A steel characterized by the presence of sulfides having globular and short blocky shapes, said steel containing in amounts by weight: aluminum 0.020% minimum, nitrogen 0.010% maximum, sulfur 0.025% maximum, manganese 0.70% maximum, from 0.020–0.080% titanium, and from 0.020–0.060% of at least one rare earth metal.

8. A steel as claimed in claim 7 wherein the titanium is present in a maximum amount of 0.060%.

9. A steel as claimed in claim 7 wherein the rare earth metal is present in a maximum amount of 0.040%.

* * * * *

UNITED STATES PATENT AND TRADEMARK OFFICE

CERTIFICATE OF CORRECTION

PATENT NO. : 4,042,381

DATED : August 16, 1977

INVENTOR(S) : Jerry D. Thomas et al

It is certified that error appears in the above-identified patent and that said Letters Patent are hereby corrected as shown below:

Column 2, line 59, "." second occurrence should be --- , --

Column 6, Table III-continued, Heat No. 2440535, first occurrence, the Ingot No. should read -- 3 T & B -- not "4 T & B"

Column 7, Table IV, V. Heat No. 2442414, "3 B & F RE .105 .05≧.15" should be -- 3 B & F RE .105 .05-.15+

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*